US008572872B1

(12) United States Patent
Michalczak

(10) Patent No.: US 8,572,872 B1
(45) Date of Patent: Nov. 5, 2013

(54) ROAD SIGN AND THE METHOD FOR PRODUCTION OF THE SAME

(76) Inventor: Roman Michalczak, Poznan (PL)

( * ) Notice: Subject to any disclaimer, the term of this patent is extended or adjusted under 35 U.S.C. 154(b) by 0 days.

(21) Appl. No.: 13/608,254

(22) Filed: Sep. 10, 2012

(30) Foreign Application Priority Data

Apr. 30, 2012 (PL) ..... 399053
Jul. 25, 2012 (PL) ..... 400128
Jul. 25, 2012 (PL) ..... 400129

(51) Int. Cl.
*G09F 15/00* (2006.01)

(52) U.S. Cl.
USPC ..... 40/607.03; 40/584; 40/616

(58) Field of Classification Search
USPC ..... 40/584, 594, 607.01, 607.03, 616
See application file for complete search history.

(56) References Cited

U.S. PATENT DOCUMENTS 842,693 A * 1/1907 Patterson ..... 40/479
5,042,183 A * 8/1991 Kennedy ..... 40/607.06
5,103,582 A * 4/1992 Farmer ..... 40/607.12
5,307,580 A * 5/1994 Farmer ..... 40/607.03
6,170,183 B1 * 1/2001 Keefe ..... 40/607.03
7,437,844 B1 * 10/2008 Kennedy ..... 40/607.03
7,743,539 B1 * 6/2010 Kennedy ..... 40/607.03

* cited by examiner

*Primary Examiner* — Gary Hoge
(74) *Attorney, Agent, or Firm* — Katten Muchin Rosenman LLP

(57) ABSTRACT

The road sign comprising a casing with an integrated post or a casing with a clamping element, characterized in that it is provided with a supporting matrix consisting of a load-bearing ribbed core (1) with vertically or horizontally oriented ribs (2) and grooves between the ribs, having a shape and size of its peripherals (3) adjusted to the shape and size of the casing, and with at least one reinforcing rod (5) situated perpendicularly to the longitudinal axis of the ribs (2) in the ribs' (2) apertures, and, additionally, characterized in that the casing side panels are provided with impressions (7) adjusted to the shape and thickness of the sign image.

9 Claims, 2 Drawing Sheets

ROAD SIGN AND THE METHOD FOR PRODUCTION OF THE SAME

Figure 1:
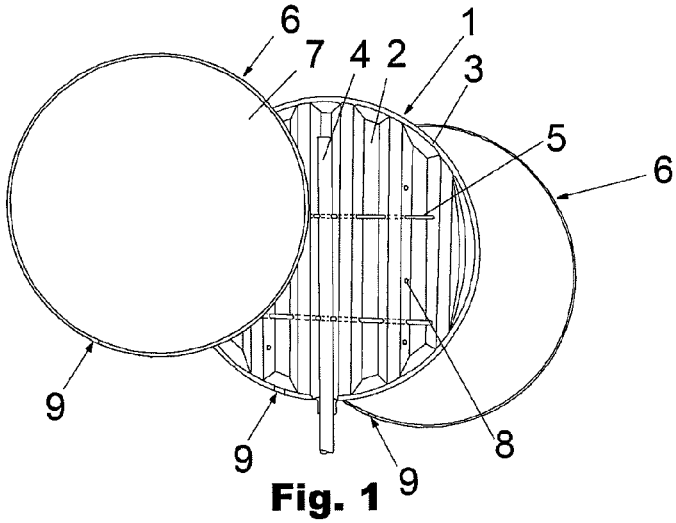

The invention discloses a road sign and a method of its production.

Conventional road signs can be divided into road signs integrated with supporting posts and road signs containing a clamping element for mounting on various poles or road and street pillars such as lamp posts, poster pillars and overhead line poles.

The invention comprises both types of road signs.

Commonly used road signs consist mainly of flat panels or boards bearing image of the sign, made of a metal, mainly steel, sheet, and are mounted on a post by means of bolts or clamps.

The Polish utility model PL65824Y1 discloses another type of a road sign having a shape of a casing consisting of two panels having a shape of shallow containers of variable sizes joined with each other by a snatching device or rivet.

The disadvantage of the known solutions is their corrodibility and vulnerability to destruction resulting from easy access to joining elements.

It is the purpose of inventors and producers to develop a solution which will outperform the conventional road signs thanks to its technical, economical and road users' safety increasing features.

The road sign according to the invention comprises a casing with an integrated post or a casing with a clamping element, characterized in that the road sign is provided with a supporting matrix consisting of a load-bearing ribbed core consisting of either vertically or horizontally oriented ribs and grooves between them, having a shape and size corresponding to the shape and size of the casing, and at least one reinforcing rod placed in the rib apertures perpendicularly to the ribs' longitudinal axis and characterized in that the external surfaces of the casing are equipped with impressions adjusted to the shape and thickness of the sign image.

Conveniently, the ribs of the load-bearing ribbed core have a trapezoid shape.

Conveniently, the ribs are provided with ventilating apertures while the bottom of the load-bearing ribbed core and the casing are provided with ventilating out-flow apertures.

Depending on specific needs, the road signs are made either with the integrated post or with a clamping element for mounting on any other poles.

The road sign with an integrated post is characterized in that the upper part of the post is embedded in the groove between the ribs of the load-bearing ribbed core where ribs are vertically oriented.

The road sign post has a shape of a cylinder externally whereas internally it has got a truncated conical hollow space tapering downwards.

The method of production of the road sign involves forming of a load-bearing ribbed core with ribs oriented vertically, joining it with the upper part of the post and then interweaving reinforcing rods through the pre-drilled apertures in the ribs and the upper part of the post and, after that, applying an adhesive on rib ridges and mounting panels on the load-bearing ribbed core.

Joining of the upper part of the post with the load-bearing ribbed core is made by applying of an adhesive onto the groove between the ribs and inserting the upper part of the post therein.

The method of production of the road sign with a clamping element involves mounting of two reinforcing flat bars in the grooves between the ribs of the load-bearing ribbed core joined by connecting means with a clamping element provided on the external part of the casing.

The connecting means consists of a bolt with a round head going through the clamping element, an external flat bar, a back panel, a load-bearing ribbed core wall, a reinforcing flat bar, a washer, a nut and a cotter pin situated outside the casing.

The solution according to the present invention has many advantages.

The load-bearing ribbed core the road signs consist of constitutes a load-bearing structure all road sign components are linked to. The components create a monolith which has influence on the stability of the spatial force system of the road sign. The reinforcing rods going through the ribs and the upper part of the post additionally stiffen the load-bearing ribbed core.

The load-bearing ribbed core, reinforcing rods, reinforcing and external flat bars, the post and panels the casing consists of are made of plastic which additionally influences the safety of the road users in case of accident.

The amount of corrodible metal elements is limited to the connecting means which improves the durability and extends lifetime of the road signs.

The additional advantage of the solution is that, while the round head of the bolt is situated outside, the washer and other joining elements are placed inside the closed casing, which prevents access thereto. Limited access eliminates the risk of the road sign destruction which improves safety.

The conical shape of the post interior cavity decreases the consumption of the plastic at the production stage while maintaining the endurance parameters of the bottom part which is most exposed to the effects of the bending moment.

The impression the casing is provided with expedites placing and sticking of the sign image on the panels.

Figure 2:
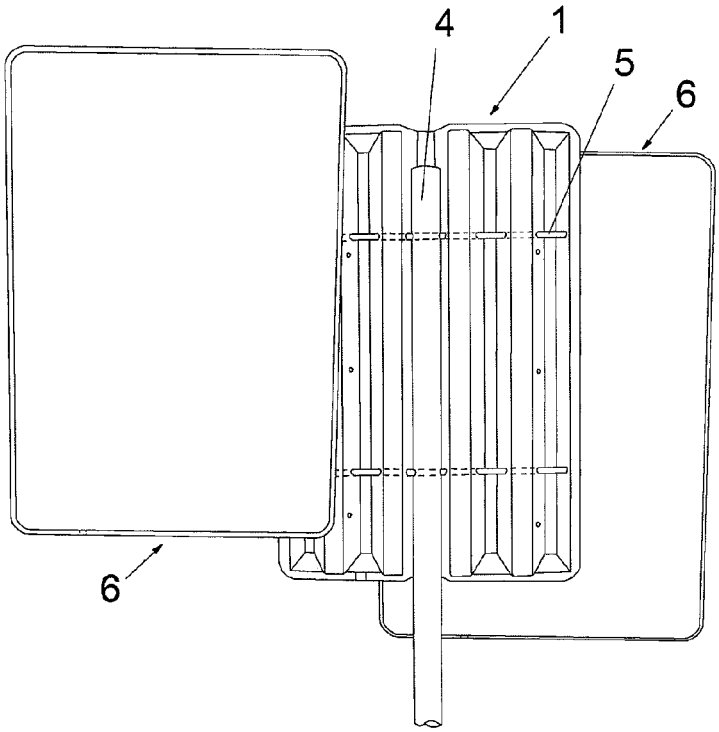
Figure 3:
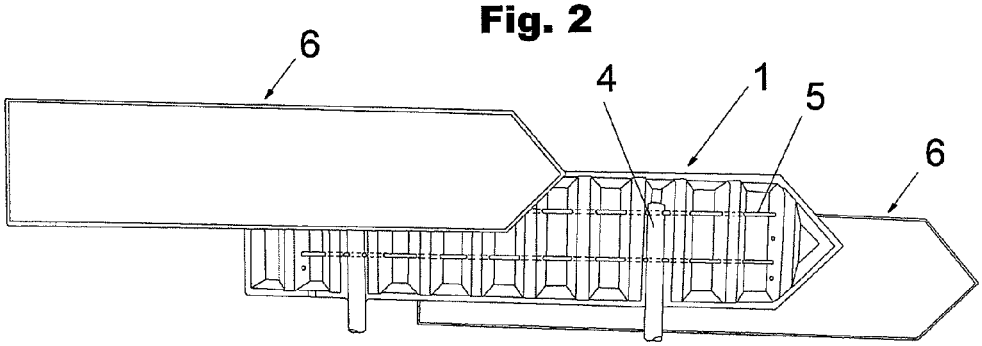
Figure 4:
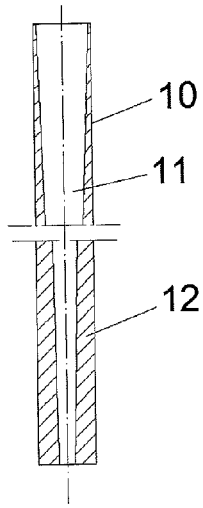

Embodiments of the invention will be illustrated by reference to the accompanying drawings in which FIG. 1 shows a round road sign, FIG. 2 a vertical rectangular road sign, FIG. 3 a horizontal rectangular road sign, FIG. 4—the longitudinal section of the post, FIG. 5—the road sign with the clamping element, taken apart, and FIG. 6—cross-section of the connecting means joining the road sign components with the clamping element.

FIGS. 1 to 4 show a road sign with an integrated post made up of load-bearing ribbed core 1 with vertical ribs 2 and core peripherals 3, the integrated post 4, reinforcing rods 5 interwoven crosswise through the ribs 2, the upper part of the post 4, and the casing consisting of two panels 6 fixed to the load-bearing ribbed core 1. The external surfaces of the panels 6 are provided with impressions 7 to fit in and stick the road sign image. The depth of the cavity 7 corresponds to the thickness of the sign image.

The ribs 2 are provided with ventilating apertures 8 while the bottom part of the load-bearing ribbed core 4 and the casing—with ventilating out-flow apertures 9. The ventilating apertures 8 allow ventilation of the closed cavity of the road sign while the ventilating out-flow apertures 9 allow airflow and offtake of water, if any.

The road sign post 4 has a shape of a cylinder 10 externally whereas internally it has got a truncated conical hollow space 11 tapering downwards. Thus, the structure of the post 4 results in irregular thickness of the post wall 12 which is increasing downwards.

Figure 5:
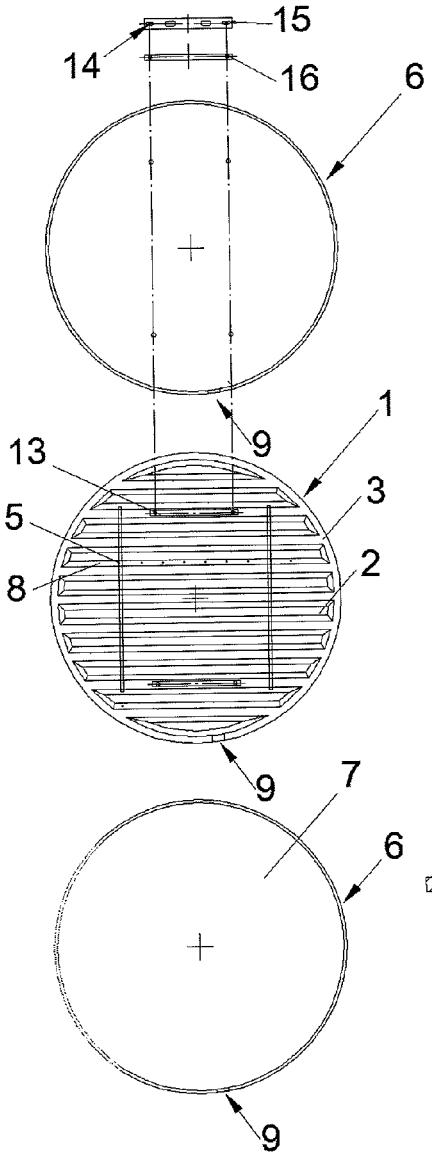
Figure 6:
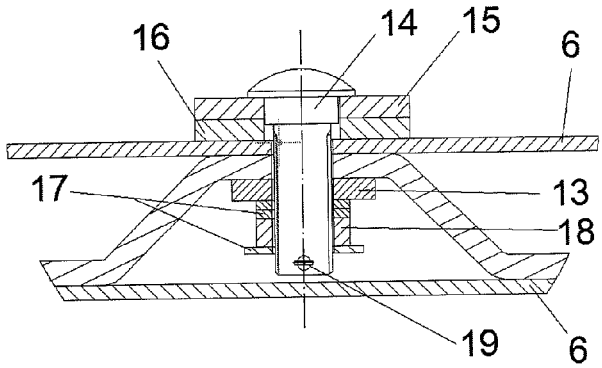

FIGS. 5 and 6 show the road sign with clamping element, consisting of a load-bearing ribbed core 1 with horizontally oriented ribs 2 and core peripherals 3, reinforcing flat bars 13 situated in the grooves between the ribs, reinforcing rods 5 interwoven through the ribs 2 and the casing consisting of two panels 6 fixed to the load-bearing ribbed core 1. Panels 6 are provided with impressions 7 the sign image is put and stuck onto. The depth of the impression 7 corresponds to the thickness of the image of the sign.

The load-bearing ribbed core 1 is connected with a clamping element 15 by the connecting means. The connecting means consists of a bolt with a round head 14 going through the clamping element 15, an external flat bar 16, a back panel 6, the wall of the load-bearing ribbed core 1, a reinforcing flat bar 13, a washer 17, a nut 18 and a cotter pin 19 situated inside the casing.

Once the components are joined, the front panel 6 is mounted on the load-bearing ribbed core 1 and the casing becomes closed with internal parts becoming inaccessible.

The road signs with the integrated post 4 are embedded on the ground along the road or pavement edges whereas the road signs with the clamping element 15 are mounted on any pole having various purposes.

The solution according to the present invention may be applied in various types of conventional road signs as well as any other notice boards.

The invention claimed is:

1. A road sign having a casing with an integrated post or a casing with a clamping element, wherein the road sign comprises:

a supporting matrix consisting of a load-bearing ribbed core (1) with either vertically or horizontally oriented ribs (2) and grooves between them, having a shape and size of core peripherals (3) corresponding to the shape and size of the casing, and at least one reinforcing rod (5) placed in rib (2) apertures perpendicularly to the ribs' (2) longitudinal axis, and wherein the external surfaces of the casing are equipped with impressions (7) adjusted to the shape and thickness of the sign image.

2. The road sign of claim 1, wherein the ribs (2) of the load-bearing ribbed core (1) have a trapezoid shape.

3. The road sign of claim 1, wherein the ribs (2) are provided with ventilating apertures (8) while a bottom part of the load-bearing ribbed core (1) and the casing are provided with ventilating out-flow apertures (9).

4. The road sign of claim 1, wherein the grooves between vertically oriented ribs (2) of the load-bearing ribbed core (1) receive the upper part of the post (4).

5. The road sign of claim 4, wherein the road sign post (4) has externally a shape of a cylinder (10) whereas internally it has a truncated conical hollow space (11) tapering downwards.

6. The road sign of claim 1, wherein two reinforcing flat bars (13) are embedded in the grooves between the ribs (2) of the load-bearing ribbed core (1) joined by connecting means with a clamping element (15) provided on the external part of the casing.

7. The road sign of claim 6, wherein the connecting means consists of a bolt with a round head (14) going through the clamping element (15), an external flat bar (16), a back panel (6), a load-bearing ribbed core (1) wall, a reinforcing flat bar (13), a washer (17), a nut (18) and a cotter pin (19) situated inside the casing.

8. A method for production of a road sign wherein a load-bearing ribbed core (1) with ribs (2) oriented vertically is formed, the upper part of a post (4) is embedded in it, reinforcing rods (5) are interwoven through pre-drilled apertures in the ribs (2) and the upper part of the post (4) and, after that, an adhesive is applied on rib (2) ridges, and panels (6) are mounted on the load-bearing ribbed core (1).

9. The method for production of claim 8, wherein the joining of the upper part of the post (4) with the load-bearing ribbed core (1) is made by applying of an adhesive onto the groove between the ribs (2) and inserting the upper part of the post (4) therein.

* * * * *